United States Patent [19]

Purcey et al.

[11] Patent Number: 4,835,802

[45] Date of Patent: Jun. 6, 1989

[54] FLUIDIZATION PATIENT SUPPORT CONTROL SYSTEM

[75] Inventors: Larry J. Purcey, Grandville; Douglas A. VanderHoff; Robert H. Vreeland, both of Grand Rapids; James P. Nielsen, Greenville, all of Mich.; Iowa Ueno, Chigasaki, Japan

[73] Assignees: The KMW Group, Inc., Grand Rapids, Mich.; Keisei Medical Industrial Co., Ltd., Tokyo, Japan

[21] Appl. No.: 158,692

[22] Filed: Feb. 22, 1988

[51] Int. Cl.[4] ..... A47C 27/08; A61G 7/00

[52] U.S. Cl. ..... 5/453; 128/33; 5/449

[58] Field of Search ..... 128/33; 5/453, 449, 5/406, 445, 430, 507, 469, 407, 403

[56] References Cited

U.S. PATENT DOCUMENTS

| | | | |
|---|---|---|---|
| 3,148,391 | 9/1964 | Whitney | 5/348 |
| 3,427,863 | 2/1969 | Hargest et al. | 5/347 |
| 3,587,568 | 6/1971 | Thomas | 5/453 |
| 3,644,950 | 2/1972 | Lindsay, Jr. | 5/347 |
| 3,866,606 | 2/1975 | Hargest | 128/71 |
| 4,114,214 | 9/1978 | VonHeck | 297/284 |
| 4,481,686 | 11/1984 | Lacoste | 5/453 |
| 4,483,029 | 11/1984 | Paul | 5/449 |
| 4,564,965 | 1/1986 | Goodwin | 5/453 |
| 4,637,083 | 1/1987 | Goodwin | 5/423 |
| 4,638,519 | 1/1987 | Hess | 5/453 |
| 4,879,776 | 4/1975 | Solen | 5/453 |

*Primary Examiner*—Edgar S. Burr
*Assistant Examiner*—Kimberly L. Asher
*Attorney, Agent, or Firm*—Price, Heneveld, Cooper, DeWitt & Litton

[57] ABSTRACT

Disclosed herein is a fluidization patient support system that enables decrease and elimination of the unpleasant and aggravating "pinging" sensation to which patients are presently exposed. The flow rate of air to the plenum chamber beneath the diffuser and fluidization material is controlled by a valve in the air flow conduit, there being a diversionary discharge outlet at the valve, such that the valve can control the ratio of air flow to the diversionary outlet and to the plenum.

3 Claims, 1 Drawing Sheet

FLUIDIZATION PATIENT SUPPORT CONTROL SYSTEM

BACKGROUND OF THE INVENTION

This invention relates to fluidization patient support systems wherein the patient lies above a porous flexible filter sheet through which pressurized air flows after passage through fluidized beads. Such systems have a granular material such as the noted beads, which material is fluidized to support the patient. This distributes the body load rather evenly for greater patient comfort. The patient actually lies above the porous filter sheet at the open top of a tank type container. This flexible sheet allows fluidization air to flow through it while retaining the beads within the tank. Patients ar sometimes thusly supported for lengthy time periods.

A rather common characteristic of present fluidized support systems is a noticeable "pinging" vibration experienced by the patient, especially around the patient's head. This pinging is believed to occur as a result of air escaping from the porous filter sheet. This pinging sensation can become increasingly annoying to the patient, especially over long periods of time. Such an annoyance is particularly disturbing to persons that are ill, disturbing their sleep and adding to their frustration.

SUMMARY OF THE INVENTION

The present invention comprises a fluidization patient support system with means for diminishing, preferably preventing, the unpleasant pinging characteristic. The invention is actually simple and inexpensive to achieve once it is understood, enabling its accomplishment without significant difficulty. Specifically, the air flow rate to the plenum beneath the diffuser of the system is governed to achieve this, using a control valve that regulates the ratio of air flow to the plenum relative to that air flow to a special diversionary discharge outlet and muffler. The valve controller enables the air flow regulation to optimize fluidization of the beads for accommodation of the size, weight and individual comfort of the particular patient, so that sufficient air flow is provided to support the particular patient but excessive flow causing pinging is prevented.

A control valve is located in the conduit, with an outlet to the diversionary discharge outlet. The control valve is variable, preferably manually, to alter the ratio of air flow between the plenum and discharge outlet.

These and other features, objects and advantages of the invention will become apparent upon studying the disclosure.

DESCRIPTION OF THE PREFERRED EMBODIMENT

Figure 1:
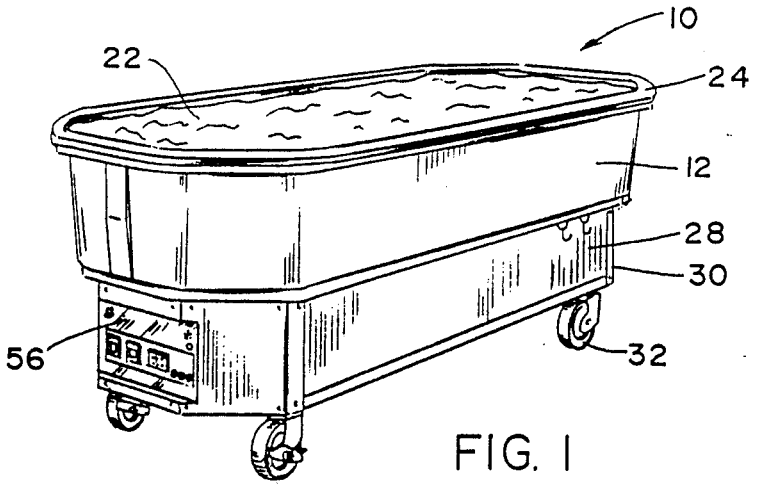
FIG. 1 is a perspective view of a fluidization patient support system according to this invention.
Figure 2:
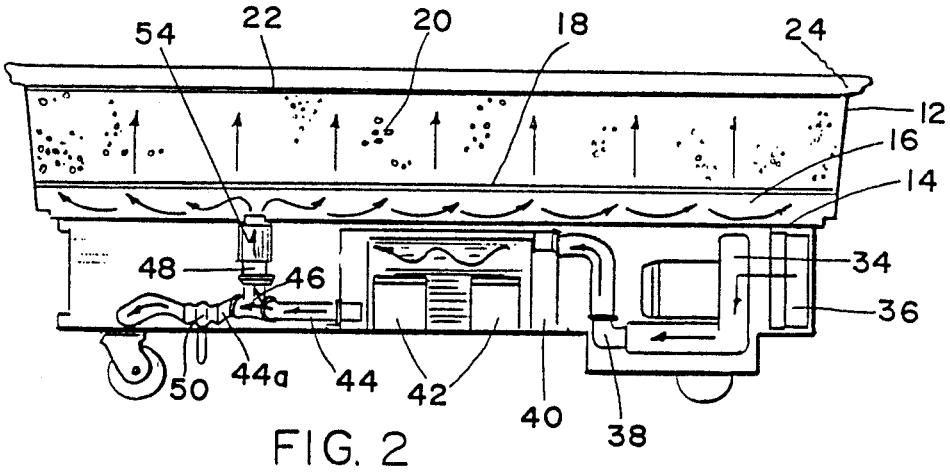
FIG. 2 is an elevational sectional view of the apparatus in FIG. 1.
Figure 3:
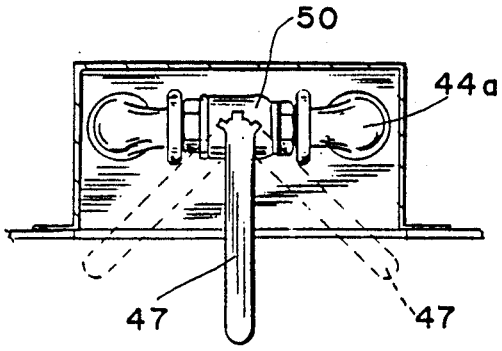
FIG. 3 is an enlarged elevational view of the control valve of this invention.
Figure 4:
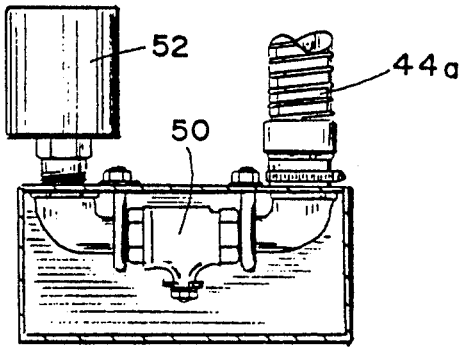
FIG. 4 is a plan view of the valve in FIG. 3 plus the diversionary discharge and muffler therefor.

The patient support system 10 depicted includes an elongated open top tank 12 defining a chamber therein. Above the bottom 14 of this tank 12 is a plenum 16 covered by a fixed diffuser plate member 18. Typically this diffuser is a solid plate having many orifices over its length and width to cause generally uniform flow of fluidization air from plenum 16 to the chamber 20 above the diffuser. This chamber contains a fluidizable, granular material such as beads of polymeric material or the like. Flow of air from plenum 16 through diffuser 18 into this material results in fluidization of the material in known fashion to support a patient. Above the fluidization chamber is a flexible, porous membrane or sheet 22 secured at its periphery adjacent the top of tank 12 by suitable retention and clamping elements 24 around the rim of tank 12.

Beneath the tank is depicted a housing 28 within framework 30 defining the housing and supporting tank 12. This entire assembly is preferably mounted on wheels 32 in conventional fashion to allow the unit to be portable.

Within housing 28 is a blower compressor 34 having an inlet and filter 36 and an outlet conduit 38 leading to a heat exchanger 40. Cooling fans 42 are used to extract any excess heat caused by the compression action of the blower compressor. Air then flows to conduit 44 leading to a Tee fitting 46. The outlets from Tee fitting 46 include conduit 48 to plenum 16 and conduit 44A through control valve 50 and in turn through muffler 52 to the ambient atmosphere therearound. Control valve 50 has actuator means 47 shown in the form of a manually operated lever or handle connected to the internal valve element (not shown). Conduit 48 has a heater 54, preferably thermostatically controlled, to regulate the temperature of air passing to the patient.

By manipulation of actuator 47, the valve can be shifted over a variety of positions to enable regulation of the ratio of air flowing to the plenum and to the diversionary discharge outlet. Using this control, the flow rate of air through diffuser 18, fluidization chamber 20 and hence through the porous, flexible membrane 22 on which the patient lies. It has been found that by such a control mechanism the unpleasant pinging sensation encountered by the patient can be diminished, and usually prevented, while allowing adjustment for the weight, size and body configuration of the patient. Controls for operating the motor compressor, the thermostatically controlled heater and other desired aspects are mounted on a control panel 56.

It is realized that once this apparatus is understood, it seems very simple in hindsight. Indeed, adaptation of the novel features to the existing structure to produce the new combination is relatively inexpensive and readily performed. Yet, this resulting combination is highly advantageous for the well being of the patient and constitutes a significant advance in this technology.

Conceivably certain minor variations could be made on the combination presented without departing from the scope of the inventive contribution. Additional accessories can be applied to the apparatus as necessary or desired. It is intended, therefore, that the invention is to be limited only by the scope of the appended claims and the reasonable equivalents thereto.

The embodiments of the invention in which an exclusive property or privilege is claimed are defined as follows.

1. A fluidization patient support system without excess air flow that causes "pinging" around the patient comprising:

an elongated fluidization tank having an open top;

a porous, flexible filter sheet secured over said open top;

fluidizable granular material below said sheet to support a patient thereon when fluidized;

a diffuser beneath said granular material to diffuse pressurized fluid flowing to said granular material and to support said granular material when not fluidized;

a plenum beneath said diffuser to receive air to be diffused;

a compressor-blower having an air inlet to the ambient atmosphere and having an outlet;

conduit means from said outlet to said plenum for conducting compressed air to said plenum and thence to said diffuser;

variable control valve means in said conduit means for controlling the flow of compressed air to said plenum;

a diversionary discharge outlet from said conduit means at said control valve means to divert air from flow to said plenum, said variable control valve means being shiftable over a variety of positions enabling control of the ratio of air flow to said plenum with respect to air flow to said diversionary discharge outlet; and actuator means for said control valve means, allowing regulation of said ratio of air flow to said plenum and said diversionary discharge outlet and thereby flow of air through said porous sheet to be regulated for providing adequate patient support while preventing excessive flow through said porous sheet causing unpleasant pinging sensations for the patient.

2. The fluidization patient support in claim 1 including sound muffling means on said diversionary discharge outlet to muffle air discharge noise.

3. The fluidization patient support in claim 2 including air temperature control means for said air flowing to said plenum.

* * * * *